US007805769B2

(12) United States Patent
Hunt

(10) Patent No.: US 7,805,769 B2
(45) Date of Patent: Oct. 5, 2010

(54) LOW-COST DISPOSABLE ODOR-REDUCING HUNTING CLOTHING

(75) Inventor: C. Timothy Hunt, 561 Lakeview Ridge, Dadeville, AL (US) 36853

(73) Assignee: C. Timothy Hunt, Dadeville, AL (US)

( * ) Notice: Subject to any disclaimer, the term of this patent is extended or adjusted under 35 U.S.C. 154(b) by 775 days.

(21) Appl. No.: 11/683,834

(22) Filed: Mar. 8, 2007

(65) Prior Publication Data

US 2007/0226868 A1 Oct. 4, 2007

Related U.S. Application Data

(60) Provisional application No. 60/780,921, filed on Mar. 9, 2006.

(51) Int. Cl.
*A41D 13/00* (2006.01)

(52) U.S. Cl. ..... 2/69; 2/243.1; 2/94

(58) Field of Classification Search ..... 2/69, 2/243.1, 94, 457, 79, 455, 77, 85, 88, 89, 2/93, 97, 108, 115, 901, 900, 400; 424/76.1, 424/76.2

See application file for complete search history.

(56) References Cited

U.S. PATENT DOCUMENTS 4,244,059 A * 1/1981 Pflaumer ..... 2/400
4,872,220 A * 10/1989 Haruvy et al. ..... 2/243.1
5,383,236 A 1/1995 Sesselmann
5,539,930 A 7/1996 Sesselmann
5,678,247 A * 10/1997 Vickers ..... 2/69
5,790,987 A 8/1998 Sesselmann
6,000,057 A * 12/1999 Newman ..... 2/69
6,009,559 A 1/2000 Sesselmann
6,134,718 A 10/2000 Sesselmann
6,348,423 B1 * 2/2002 Griffiths et al. ..... 442/123
7,260,853 B2 * 8/2007 Newman ..... 2/115
7,310,824 B2 * 12/2007 Walsh ..... 2/122
7,328,789 B2 * 2/2008 Bohanan et al. ..... 206/210
2002/0069904 A1 * 6/2002 Robinson ..... 135/87
2004/0107474 A1 6/2004 Sesselmann
2006/0147698 A1 * 7/2006 Carroll et al. ..... 428/316.6

(Continued)

OTHER PUBLICATIONS

Natural Predator, LLC; Get Down and Dirty with TRU-Carbon scent eliminator!; wwww.naturalpredator.com/About Us.asp; On or before Mar. 5, 2007; 3 pages.

(Continued)

*Primary Examiner*—Amy B Vanatta
(74) *Attorney, Agent, or Firm*—Gardner Groff Greenwald & Villanueva, PC

(57) ABSTRACT

Disposable clothing articles for hunting and other outdoor activities are made of a low-cost, lightweight, breathable material, preferably a non-woven with particle barrier properties, and preferably include cinching elements for cinching closed with a good seal the hand and foot openings of the clothing to prevent the escape of human odors. The clothing articles are treated with one or more odor-reducing agents to absorb the human odors that pass through the clothing material. In an example method of making the clothing articles, a liquid odor-reducing agent is sprayed onto the clothing, one or two powder odor-reducing agents are sprinkled onto the inside and outside surfaces of the clothing, and the treated clothing article is stored in a sealable bag or other container.

8 Claims, 6 Drawing Sheets

U.S. PATENT DOCUMENTS

| | | | | |
|---|---|---|---|---|
| 2006/0191058 | A1* | 8/2006 | Huza | 2/239 |
| 2007/0092479 | A1* | 4/2007 | Turriff | 424/76.2 |
| 2007/0151877 | A1* | 7/2007 | Newman | 206/278 |
| 2009/0114228 | A1* | 5/2009 | Kirschner | 128/206.13 |

OTHER PUBLICATIONS

Dupont; Tyvek & ProShield General Protection; www2.dupont.com/NASApp/DPPRequestGateway/0/5/?command=VCProtection....; On or before Mar. 6, 2006; 3 pages.

* cited by examiner

LOW-COST DISPOSABLE ODOR-REDUCING HUNTING CLOTHING

CROSS-REFERENCE TO RELATED APPLICATIONS

This application claims the priority benefit of U.S. Provisional Patent Application Ser. No. 60/780,921 filed Mar. 9, 2006, which is hereby incorporated herein by reference.

TECHNICAL FIELD

The present invention relates generally to clothing for hunters and, in particular, to hunting clothing for reducing the ability of wild game animals to detect the scent of the hunter.

BACKGROUND OF THE INVENTION

Many wild animals have exceptional odor-sensing abilities, which they use to evade humans by detecting their presence and fleeing from the area. There are situations when people desire to approach wild animals, including hunting, wildlife photography, etc. In these cases, people often attempt to conceal their scent using any of a variety of products including masking agents, scented soaps, scent-absorbing suits, etc.

One known type of scent-absorbing clothing is sold under the SCENT-LOK brand by A.L.S. Enterprises, Inc. of Muskegon, Mich. These clothing items include jackets, pants, shirts, coveralls, bib overalls, and head covers that are camouflaged and made of a scent-absorbing material. But these SCENT-LOK clothing items are expensive—a standard pants and shirt together typically cost over $200. This is just too expensive for a large portion of the hunters in the general U.S. population.

Accordingly, it can be seen that a need exists for improvements to scent-absorbing clothing to make it affordable to more people without sacrificing its scent-absorbing capabilities. It is to such improvements to that the present invention is primarily directed.

SUMMARY OF THE INVENTION

Generally described, the present invention provides odor-reducing clothing for use by hunters and outdoorsmen to help avoid detection by game animals. A full suit of the clothing articles includes one head cover, two hand covers, two foot covers, and a coverall suit or pant/short sets. The full suit includes cinching elements that close off and form a good seal at hand openings and foot openings of the clothing articles. In this way, human odor and human-borne scents (soap, shampoo, deodorant, etc.) are prevented from escaping through the hand and foot openings, as they normally do.

In example embodiments, the clothing articles are made of low-cost, lightweight, breathable materials. In a typical commercial embodiment, the material is non-woven and has particle barrier properties. Suitable low-cost, lightweight, breathable, non-woven materials with particle barrier properties include the fabrics used in painter's coveralls and chemical suits for industrial applications.

The clothing articles are treated with at least one odor-reducing agent of a type that is known in the art. In a typical commercial embodiment, the clothing article is sprayed on the inside and/or outside surface with liquid chlorophyll, sprinkled on the inside surface with baking soda in powder form, and sprinkled on the outside surface with activated carbon powder. In other embodiments, only two or one odor-reducing agent is applied, or other types of odor-reducing agents are used.

The combination of the low costs of the clothing material, the odor-reducing agents, and the agent treatment methods results in a clothing article that provides outstanding odor-reduction in the field, but that is very low in cost, comparatively speaking. In particular, when wearing the odor-reducing clothing articles, hunters are able to get into sufficiently close proximity to the game animals being sought, in many cases when the conditions are good (when downwind from the animal, etc.) as close as or even closer than thirty yards. In typical commercial embodiments described herein, full suits of the clothing articles can be sold at a retail price of about $40 to $50. While the clothing articles are not intended to be washed and reused repeatedly, users may find that in most cases they can get on the order of about five to seven hunts out of one suit (when re-treated with the odor-reducing agents between uses). This compares with typical scent-containment suits that retail for over $200 and are good for maybe about one hunting season, depending on the frequency of use. In addition, the clothing articles can be folded up and stored in their plastic bag in a very compact package relative to the bulky scent containment suits currently available. This lightweight, compact packaging allows a full suit of the clothing article to be easily stored in a hunter's gear box, which is a nice advantage for the hunter on the go, for example, one who may want to get in a few hours of hunting before or after work.

In another aspect of the invention, there is provided a method of making the clothing articles, including the odor-reducing agent treatments described herein. In yet another aspect of the invention, there is provided a home-assembly kit, including the clothing articles and the odor-reducing agents for application by the end-user. And in still another aspect of the invention, there is provided a method of hunting, including the odor-reducing agent treatments described herein.

The specific techniques and structures employed by the invention to improve over the drawbacks of the prior devices and accomplish the advantages described herein will become apparent from the following detailed description of the example embodiments of the invention and the appended drawings and claims.

DETAILED DESCRIPTION OF EXAMPLE EMBODIMENTS

The present invention comprises clothing articles that are made of a low-cost material and include one or more odor-reducing agents. The odor-reducing agents are selected for making it more difficult for wild game animals to detect the wearer by picking up the odor of the human body and/or other scents on humans (from soap, shampoo, deodorant, cologne, laundry detergent in clothing, etc.). The low cost material is selected so that it is sufficiently durable for at least one use (preferably, at least one full day in the woods for hunting, etc.), but at the same time sufficiently inexpensive that the cost of the clothing articles is generally affordable to the average person.

As used herein the phrase "preventing the escape of human odors" and the like is intended to mean preventing the escape of human odors and/or human-borne scents (soap, shampoo, deodorant, etc.) completely or at least sufficiently that wild game animals cannot easily detect the human presence and flee from the area before the human can get close enough to the animal for his intended purpose. And "odor-reducing" means eliminating and/or merely reducing human odors and/or human-borne scents sufficiently for the purposes stated herein.

With reference now to the appended drawings, FIGS. 1-6 show clothing articles 10*a-f* according to example embodiments of the invention. These are referred to herein at places collectively as the "clothing articles 10." It will be understood that other types of clothing articles, such as sox, scarves/mufflers, and undergarments, and other configurations of the clothing articles shown and described herein, are contemplated by the present invention.

Figure 1:
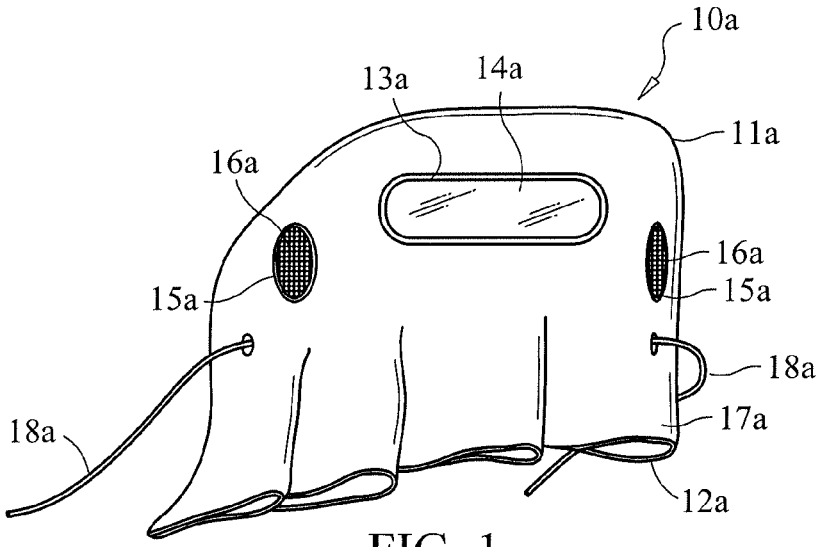
FIG. 1 is a front view of a head cover according to a first example embodiment of the present invention.

The clothing article of FIG. 1 is a head cover 10*a*. The head cover 10*a* comprises a hood 11*a* with a neck opening 12*a* so that the hood fits over and covers the wearer's head. The hood 11*a* has at least one viewing opening 13*a* in the front adjacent the wearer's face (or at least the eyes), and at least one sheet 14*a* of clear plastic or other generally transparent material spanning the front viewing opening to permit the wearer to see. In addition, the hood 11*a* has two ear openings 15*a* in opposing sides adjacent the wearer's ears to permit the wearer to hear, and may have a sheet 16*a* of mesh, screening, or other material selected for permitting good ventilation, that covers the side ear openings. The hood 11*a* has a lower portion 17*a* adjacent the neck opening 12*a* that drapes down onto the wearer's shoulders, and includes a cinching element 18*a* such as a drawstring, belt, strap, flap with a snap or button, elastic band, or other adjustability element to provide a snug but comfortable fit that prevents the escape of human odors.

In the described embodiment, the viewing opening 13*a* and the neck opening 12*a* are designed to prevent the escape of human odors from them, but the ear openings 15*a* are not so that the wearer can hear better as well as for breathability and wearer comfort. In alternative embodiments, the ear openings are eliminated or covered with a sheet of material treated with an odor-reducing agent to prevent the escape of human odors therethrough. In other alternative embodiments, the hood has at least one breathing opening adjacent the wearer's nostrils or mouth, with the breathing opening covered by a filter element including an odor-reducing agent. And in still other alternative embodiments, the head cover is provided as a head-net, a hat or cap, or form-fitting headwear (ala ski masks).

Figure 2:
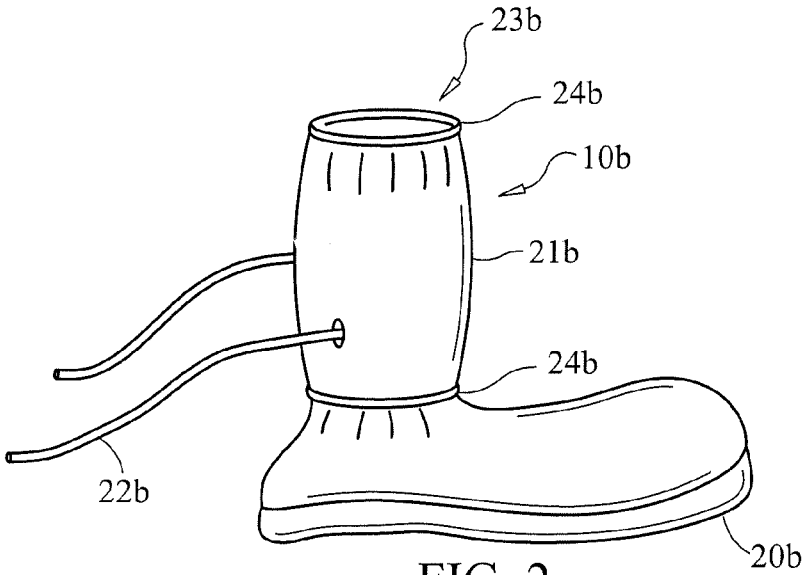
FIG. 2 is a side view of a foot cover according to a second example embodiment of the present invention.

The clothing article of FIG. 2 is a foot cover 10*b*. The foot cover 10*b* is typically provided in pairs, each being wearable on either the left or right foot and sized to be worn on a range of different foot sizes (e.g., S, M, and L). The foot covers 10*b* are sized and shaped to be worn over the user's shoes, boots, etc., so that they fit over and cover the wearer's regular footwear. Preferably, the foot covers 10*b* include a bottom sole 20*b* that is sufficiently durable to last at least one use in normal outdoor conditions without wearing through. The foot covers 10*b* have upper portions 21*b* that extend upwards, for example, to just below the knees. Below the leg opening 23*b*, the upper portions 21*b* include a cinching element 22*b* such as a drawstring, belt, strap, flap with a snap or button, elastic band, or other adjustability element to provide a secure but comfortable fit that prevents the escape of human odors. In addition, the foot covers 10*b* preferably includes one or more additional cinching elements 24*b* to further provide for a secure but comfortable fit that prevents the escape of human odors. For example, the depicted embodiment includes the first cinching element 22*b* in the form of a drawstring, a second cinching element 24*b* in the form of a circumferential elastic band positioned at about the ankle, and a third cinching element 24*b* in the form of a circumferential elastic band positioned adjacent the leg opening 23*b*. In alternative embodiments, the foot covers 10*b* are provided as a left or right specific, they are sized for one specific size of foot, and/or they are made of a material sufficiently durable to be worn without boots or shoes underneath.

Figure 3:
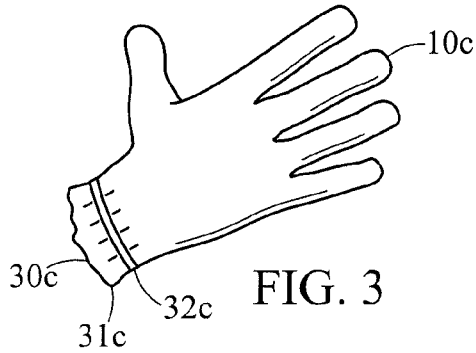
FIG. 3 is a plan view of a hand cover according to a third example embodiment of the present invention.

The clothing article of FIG. 3 is a hand cover 10*c*. The hand cover 10*c* is typically provided in pairs, each being wearable on either the left or right hand and sized to be worn on a range of different hand sizes (e.g., S and L, or one size fits all), whether over a regular glove in cold weather or by itself in warm weather. The hand covers 10*c* each have a hand opening 30*c* through which the wearer inserts the hand, a wrist portion 31*c* that extends over the wearer's wrist and that is adjacent the hand opening. The wrist portion 31*c* includes a cinching element 32*c* such as an elastic band, drawstring, belt, strap, flap with a snap or button, or other adjustability element to provide a secure but comfortable fit that prevents the escape of human odors.

Figure 4:
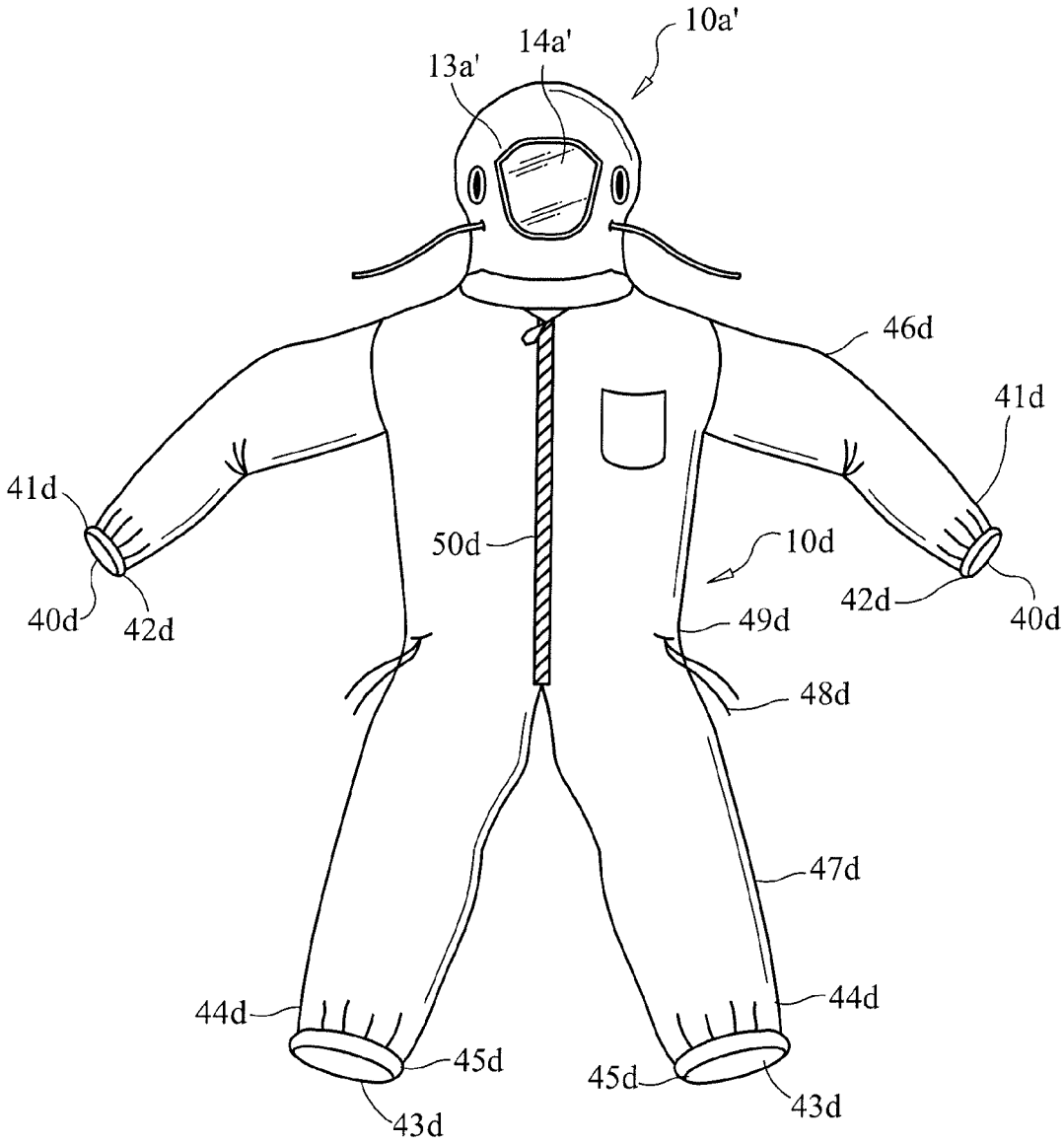
FIG. 4 is a front view of a coverall suit according to a fourth example embodiment of the present invention, including a head cover that is similar to that of FIG. 1.

The clothing article of FIG. 4 is a coverall suit 10*d* that is provided with a head cover 10*a*'. The coverall suit 10*d* is sized and shaped to cover the wearer's entire body, except for the feet and hands. The coverall suit 10*d* includes hand openings 40*d* through which the wearer can insert the hands, wrist portions 41*d* that extend over the wearer's wrist and that are adjacent the hand openings, and wrist cinching elements 42*d* at the wrist portions. Similarly, the coverall suit 10*d* includes foot openings 43*d* through which the wearer can insert the feet, ankle portions 44*d* that extend over the wearer's ankles and that are adjacent the feet openings, and ankle cinching elements 45*d* at the ankle portions. The wrist cinching elements 42*d* and the ankle cinching elements 45*d* are each an elastic band, drawstring, belt, strap, flap with a snap or button, or other adjustability element to provide a secure but comfortable fit that prevents the escape of human odors. The wrist cinching elements 42*d* and the ankle cinching elements 45*d* also allow the arm sleeves 46*d* and pant legs 47*d* of the suit to be adjustably rolled and/or pulled up. In addition, the coverall suit 10*d* preferably includes a waist portion 49*d* including a waist cinching element 48*d* such as a drawstring, belt, elastic band, or the like for adjustability to provide a comfortable fit.

With the adjustable arm sleeves, pant legs, and waist, the coverall suit 10*d* can be provided in a limited number of sizes each suitable for being worn on a range of different-sized human bodies (e.g., S, M, and L). Furthermore, the coverall suit 10*d* preferably includes a low-cost closure 50*d*, such as a metal or plastic zipper or zipper-like closure, in the front for quickly and easily putting on and taking off the suit, and such a closure may also be included on the outsides of the pants legs.

In alternative embodiments, the coverall suit has one or more openable panels (e.g., by a plastic zipper) for relieving oneself without removing the coverall, the front closure is provided by two continuous overlapping vertical flaps with snaps so that the flaps can be folded and snapped in place to prevent the escape of human odor, and/or the coverall suit includes integral or detachable hand and feet covers. It is contemplated by the present invention that the coverall suit may be provided with the wrist closures and the ankle closures positioned thereon at positions higher on the arm sleeves and pant legs than the wrists and ankles, respectively, and these positions are intended to be within the scope of the invention.

The head cover 10*a*' is similar to the head cover 10*a* of FIG. 1, except that it has a larger viewing opening 13*a*' and viewing cover 14*a*' for better visibility. The head cover 10*a*' and the coverall suit 10*d* can be provided as two separate pieces that can be worn together. For example, the head cover 10*a*' and the suit 10*d* may include a coupling such as a zipper so that the head cover can be detached. Alternatively, the head cover 10*a*' and the suit 10*d* can be provided as one integral piece, for example, with the head cover including a flap portion that is closeable by a zipper or other coupling.

Figure 5:
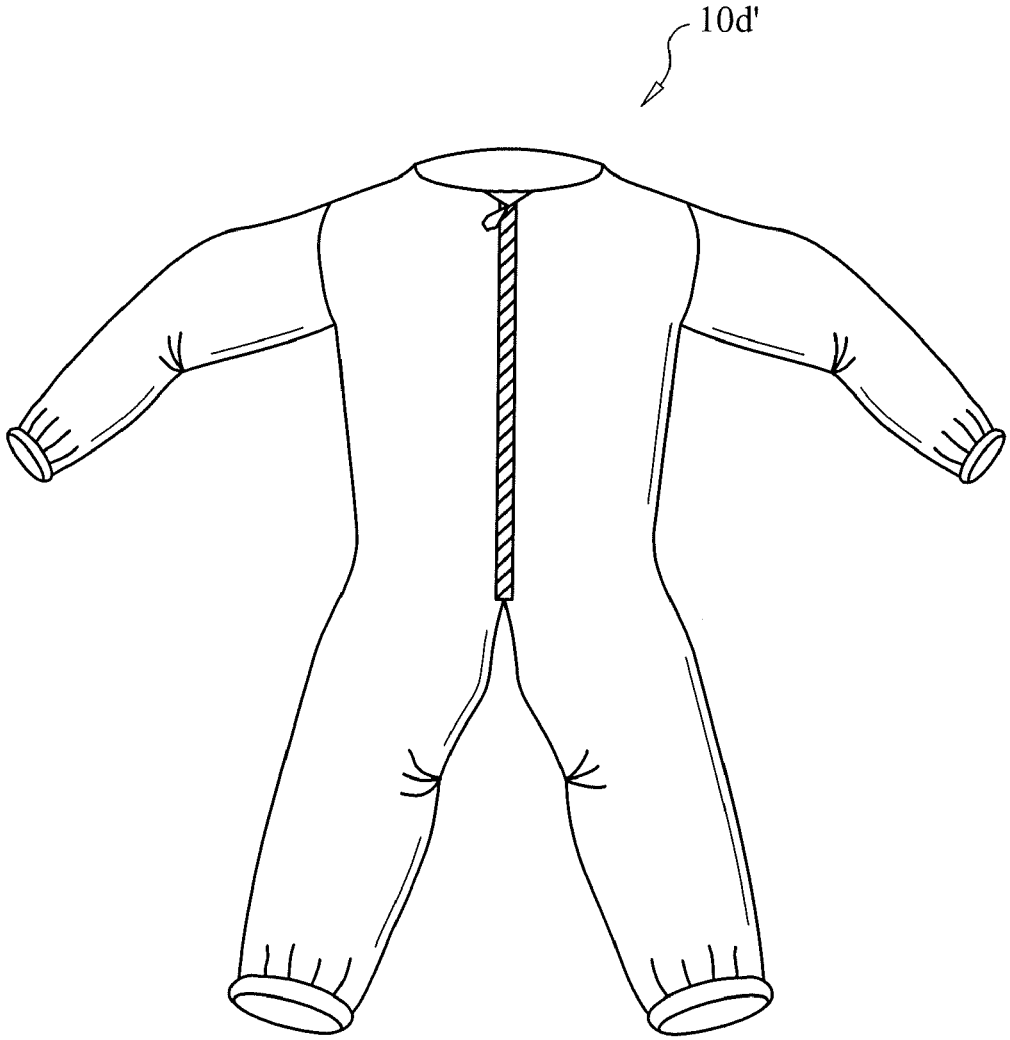
FIG. 5 is a front view of a coverall suit according to a fifth example embodiment of the present invention, with the coverall suit being similar to that of FIG. 4.

The clothing article of FIG. 5 is a coverall suit 10*d*' that is similar to the coverall suit 10*d* of FIG. 4, except that it does not include a head cover or a coupling for attaching a detachable head cover. The coverall suit 10*d*' is for use with the head cover 10*a* of FIG. 1 and the foot cover 10*b* of FIG. 2.

Figure 6:
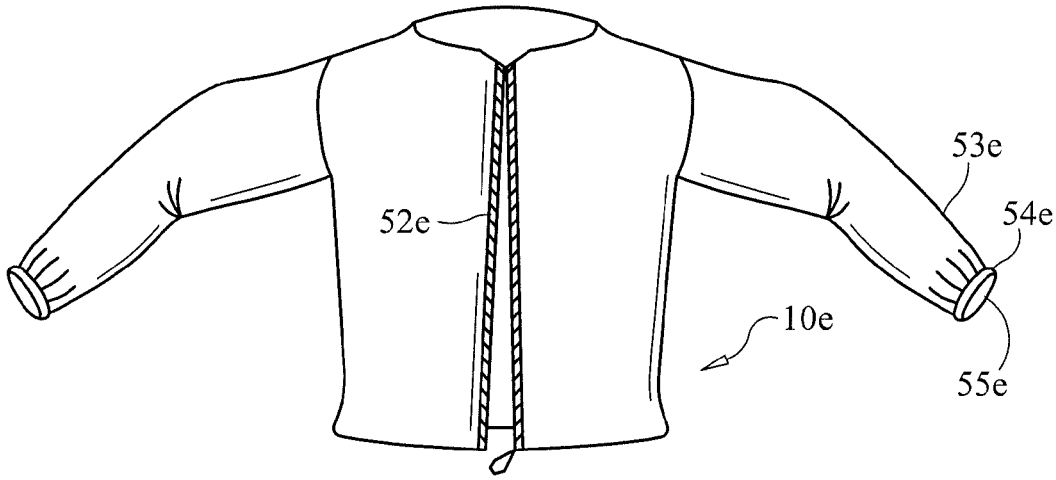
FIG. 6 is a front view of a shirt and pants set according to a sixth example embodiment of the present invention, with the shirt and pants set designed for use together.
Figure 6:
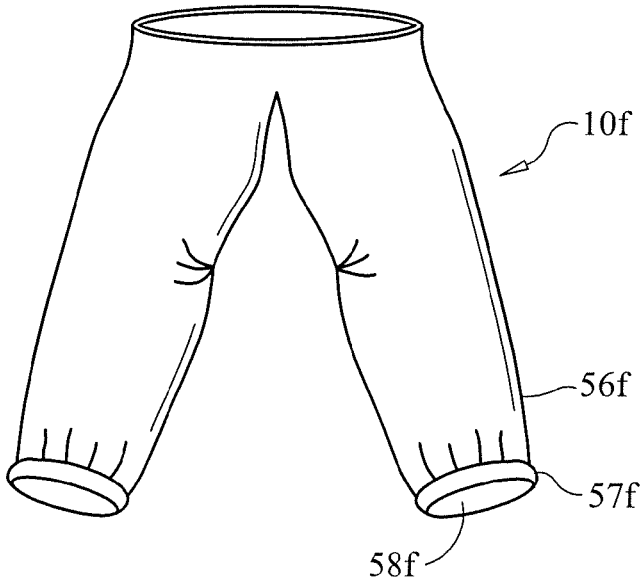

The clothing article of FIG. 6 is a set of a shirt 10*e* and pants 10*f* that are designed for use together. The shirt 10*e* has a front zipper, snaps, or another low-cost closure 52*e*, and wrist portions 53*e* with wrist cinching elements 54*e* that are adjacent hand openings 55*e*. The pants 10*f* have ankle portions 56*f* with ankle cinching elements 57*f* that are adjacent foot openings 58*f*. The wrist cinching elements 54*e* and the ankle cinching elements 57*f* are each an elastic band, drawstring, belt, strap, flap with a snap or button, or other adjustability element to provide a secure but comfortable fit that prevents the escape of human odors. The shirt 10*e* tucks into the waist of the pants 10*f* to prevent the escape of human odor. Furthermore, the pants 10*f* preferably include low-cost zippers or other closures on the outsides of the pants legs.

Accordingly, the clothing articles 10 include cinching elements that, when cinched closed, form a good seal to eliminate or at least substantially reduce the passage of air through the openings in the clothing for the hands, feet, etc. The good seal is formed between overlapping clothing articles (e.g., foot covers and pant legs), against the wearer's regular clothing (when worn as over-clothing), or against the wearer's skin (when worn without regular clothing underneath). In this way, a person can wear a full suit of the clothing articles with no exposed skin area, so that any odors or scents that may emanate from the person must pass through the clothing article material. A "full suit" of the clothing articles includes one head cover, two hand covers, two feet covers, and one pant/shirt or coveralls. It will be understood that the coverall suit or shirt/pant set can be provided and used without the cinching elements if they are worn with, tucked into, and cinched by hand and feet covers having the cinching elements.

Having described some basic configurations of the clothing articles 10, details of the low-cost material and scent-reducing agents will now be provided. The material used for the clothing articles 10 is selected for having a sufficiently low cost that the clothing articles are generally affordable by the general population of the U.S., for durability sufficient to last at least one use (e.g., a day of hunting in the field) and preferably a few uses, and for at least minimal levels of comfort. In this way, the clothing articles 10 are disposable after one use, although they could be reused in cases where the user did not wear the clothing for a full day, perspired very little relative to normal, and/or does not need to get as close to animals the next time out. In addition, a camouflage pattern is preferably included on the material to assist in avoiding visual detection by the game animals. Several different camouflage patterns may be used, depending at least in part on the environment in which the person wishes to remain undetected.

For comfort, the material preferably is a lightweight breathable fabric. As used herein, a "breathable" fabric or material is one that, when fashioned into a full suit of the clothing articles that is worn with the cinching elements cinched to form good seals preventing the escape of human odors, will allow the passage of air and moisture through it sufficient that wearing the full suit of clothing articles for at least four consecutive hours in normal hunting weather conditions is tolerable if not comfortable to the average person. "Normal hunting weather conditions" are intended to mean temperatures of less than about 80 degrees Fahrenheit. Suitable breathable materials include non-woven fabrics commercially available and promoted as "letting air in but not out."

At the same time, to assist in odor reduction by containment, the material is preferably non-woven with particle barrier properties. Example materials suitable for use include fabrics typically used in conventional painter's coveralls and fabrics typically used in chemical suits for industrial applications. These non-woven materials have particle barrier properties and act as a barrier to keep out particles of paint, dust, asbestos, etc. In the present invention, rather than keeping out particles, the same material functions as a barrier to help keep in human odor and human-borne scents.

Other known suitable materials with particle barrier properties include TYVEK brand fabrics and PROSHIELD brand fabrics, both available from E.I. du Pont de Nemours and Company (Wilmington, Del.). The TYVEK brand fabric is believed to be made with proprietary DUPONT technology to keep out and provide "protection from lead dust, mold, asbestos, and other dry particle and aerosol hazards." The TYVEK brand fabric, and similar fabrics, are well suited because they are lightweight, breathable, and disposable/low-cost, and they also have particle barrier properties sufficient to prevent the escape of human odor. In addition, DUPONT provides general protection garments made of the TYVEK brand fabric, including coverall suits similar to those of FIGS. 4 and 5. These general protection garments do not include the ankle and wrist cinching elements of the coverall suits described herein, however, the pant legs and arm sleeves of these garments can be tucked into and cinched by the foot and hand covers of FIGS. 2 and 3 to prevent the escape of human odor. The TYVEK brand fabric, or a similar fabric, is well suited for making a first product line of the clothing articles 10 that is for use in generally dry conditions. And the PROSHIELD brand fabric, or a similar fabric, is well suited for making a second product line of the clothing articles 10 that is water-repellant for use in generally rainy or otherwise damp or wet conditions.

The odor-reducing agents are selected so that, when incorporated into the clothing articles 10, the clothing can be worn over a person's regular clothing to eliminate or reduce human odor sufficiently to allow a person in the field to get closer to game animals undetected. The mechanism by which the odor-reducing agent can reduce or eliminate odor will vary depending upon the selection and amount of agent that is incorporated into the clothing article. For example, the odor-reducing agent can absorb (i.e., trap) odor-producing molecules. Alternatively, the odor-reducing agent can interact with the odor-producing molecule to render the odor-producing molecule non-odorous. The type of interaction that can occur between the odor-reducing agent and the odor-producing molecule can be covalent or non-covalent (e.g., ionic, electrostatic, dipole-dipole, etc.). The amount of odor-reducing agent incorporated into the clothing article will vary depending upon the selection of the odor-reducing agent and the fibers used to produce the clothing article.

In a typical commercial embodiment, the clothing articles 10 are treated with three odor-reducing agents. For example, the clothing articles 10 can be treated with baking soda as a first low-cost odor-reducing agent, with activated carbon as a second low-cost odor-reducing agent, and with chlorophyll as a third low-cost odor-reducing agent. A suitable activated carbon agent is available under the brand name TRU-CARBON from Natural Predator, LLC d/b/a Natural Predator Outdoor Products (De Pere, Wis.). The activated carbon agent may be applied in dry powder form by sprinkling it on, or the powder may be dissolved in purified water to form a liquid solution that may by applied by spraying it on. In other typical commercial embodiments, the clothing articles 10 are treated with only two or one of these odor-reducing agents. In some of these embodiments, the clothing articles 10 are also treated with other agents such as, for example, an odorless insect repellant such as pyrethrum and/or cover scents such as pine.

In alternative embodiments, the odor-reducing agents can be inorganic compounds, hydrazines, organic polymers, and mixtures thereof. Methods for incorporating odor-reducing agents into fibers are disclosed in U.S. Pat. No. 6,077,794 and U.S. Published Application No. 20040219126, which are incorporated by reference with respect to their disclosures of different types of deodorant compositions and methods for incorporating the deodorant compositions into fibrous materials.

Examples of inorganic compounds include porous substances formed from silicon dioxide, titanium dioxide, zinc oxide, aluminum oxide or the like, porous substances such as zeolite, silica gel, active carbon or the like, or organic acid salts such as acetates or citrates, inorganic acid salts such as sulfates, phosphates, nitrates, chlorides, hydroxides, or oxides of metal such as copper, zinc, zirconium, silver, lead, iron, aluminum, calcium, magnesium, manganese, nickel, cobalt or the like, and the like.

Examples of the hydrazide compounds usefulk herein include, but are not limited to, monohydrazides such as formohydrazide, acetohydrazide, hydrazide propionate, hydrazide laurate, hydrazide stearate, hydrazide salicylate, hydrazide benzoate, hydrazide p-hydroxybenzoate, methyl carbazate, ethyl carbazate, semicarbazide hydrochloride and the like, dihydrazides such as carbohydrazide, dihydrazide oxalate, dihydrazide malonate, dihydrazide succinate, dihydrazide glutarate, dihydrazide adipate, dihydrazide pimelate, dihydrazide suberate, dihydrazide azelate, dihydrazide sebacate, dihydrazide terephthalate, dihydrazide isophthalate, dihydrazide tartarate, dihydrazide malate, dihydrazide iminodiacetate, dihydrazide itaconate, dodecane dihydrazide, hexadecane dihydrazide, dihydrazide 2,6-naphthoate, dihydrazide 1,4-naphthoate, 4,4-bisbenzene dihydrazide, 2,6-pyridine dihydrazide, 1,4-cyclohexanedihydrazide, N,N'-hexamethylene bis-semicarbazide and the like, trihydrazides such as trihydrazide citrate, trihydrazide pyromellitate, 1,2,4-benzene trihydrazide, trihydrazide nitriloacetate, trihydrazide cyclohexane tricarboxylate and the like, tetrahydrazides, such as tetrahydrazide ethylenediamine tetraacetate, tetrahydrazide 1,4,5,8-naphthoate and the like may be cited.

Examples of polymers useful as odor-reducing agents include polyvinyl amine. Polyvinyl amine compound can be obtained by the polymerization of N-vinyl formmide, N-vinyl acetamide or the like in an aqueous solution followed by hydrolysis by an acid or a base. It is also possible to copolymerize other type of vinyl monomers, for example, acrylic acid, acrylamide, acrylonitrile, ethylene, styrene, vinyl acetate or the like during the polymerization of the polyvinyl amine.

Figure 7:
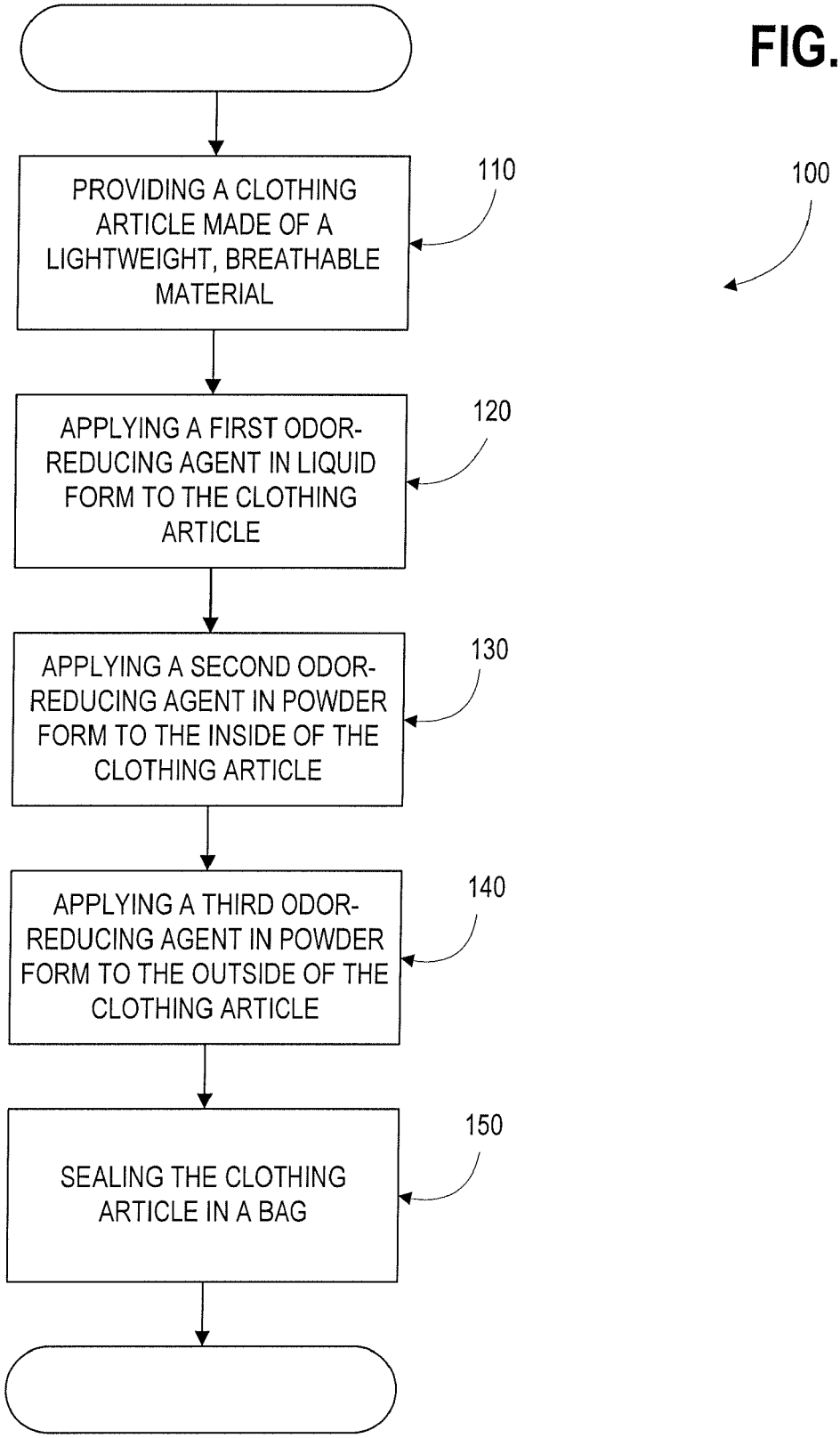
FIG. 7 is a flow diagram of a method of making an odor-reducing clothing article according to any of the example embodiments of the present invention.

Referring to FIG. 7, the present invention also provides a method 100 of making the low-cost, disposable clothing articles 10. At step 110, the method includes providing a clothing article made of a low-cost, lightweight, breathable material. The clothing article may be fabricated on-site from the material or purchased from an outside supplier.

Figure 8:
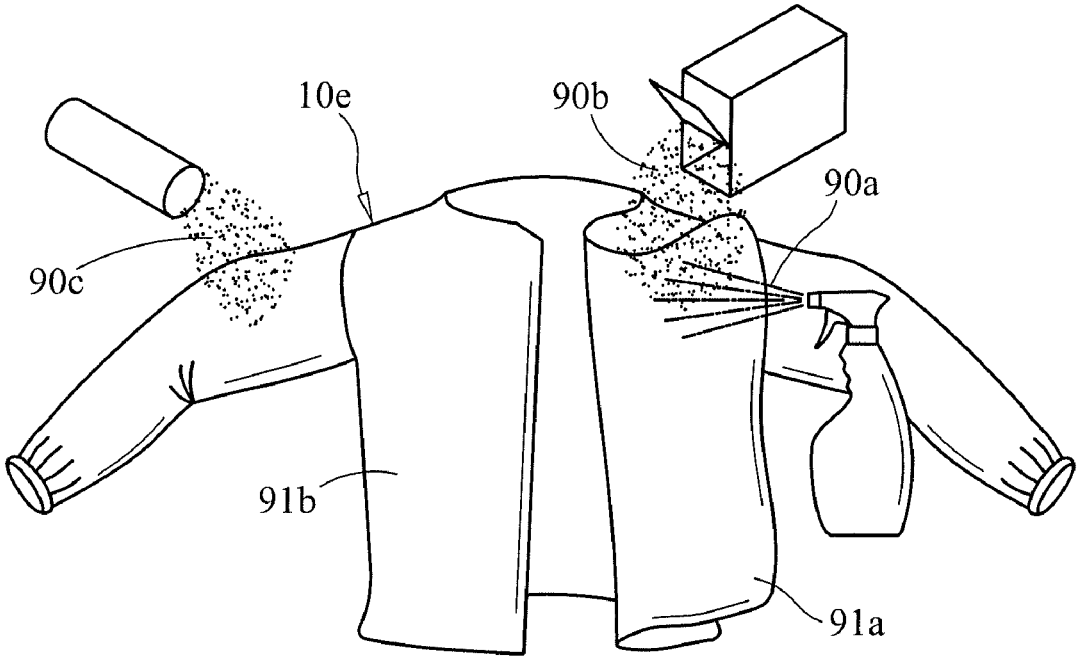
FIG. 8 is a front view of the shirt of FIG. 6, showing odor-reducing agents being applied to it according to the method of FIG. 7.

The method further includes the step of treating the clothing article with one or more odor-reducing agents (collectively, "odor-reducing agents 90"). In a typical commercial embodiment, the method includes three treatments steps, as shown in FIG. 8. At step 120, a first odor-reducing agent is applied. For example, chlorophyll 90*a* in liquid form can be sprayed onto substantially all of the inside and/or outside surface of the clothing article 10*e*. To spray onto the inside surface 91*a*, the clothing article 10*e* is first turned "inside out." When applied to a preferred fabric material with absorptive properties, the sprayed-on liquid is absorbed into the material after a short time so that the material is again substantially dry. At step 130, a second odor-reducing agent is applied. For example, baking soda 90*b* in powder form can be sprinkled onto substantially all of the inside surface 91*a* of the clothing article 10*e*. This can be done with the clothing article 10*e* still "inside out," or after returning it back to "outside out" (normal) for wearing. And at step 140, a third odor-reducing agent is applied. For example, activated carbon 90*c* in powder form can be sprinkled onto substantially all of the outside surface 91*b* of the clothing article 10*e*. In this embodiment, the odor-reducing agents themselves, as well as the methods by which they are applied, are low in cost relative to other odor-reducing clothing articles, yet the resulting odor-reducing clothing articles provide effective odor-reduction in the field.

Figure 9:
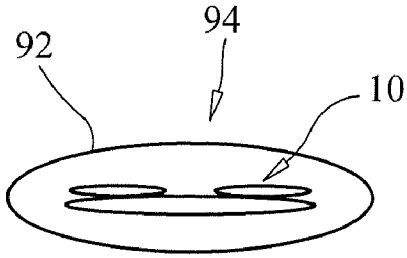
FIG. 9 is a side view of the odor-reducing-agent-treated shirt of FIG. 6 packaged in a sealed plastic bag to retain the odor-reducing agents therein.

Finally, the method includes the step 150 of folding the clothing article (if needed), inserting it in to a sealable container 92 such as a plastic bag, and storing it in the bag, resulting in the ready-for-use odor-reducing clothing article 94 (see FIG. 9). It should be noted that a light dusting of the powder form odor-reducing agents 90*b* and 90*c* sprinkled onto the clothing article 10*e* is usually all that is needed to apply these agents. The powder 90*b* and 90*c* need not be adhered to the surface of the clothing article 10*e* because when the clothing article is packaged in the sealed plastic bag 92, all or enough of the powder is retained inside to accomplish the intended odor reduction, even if some of the powder falls out when the bag is opened and the clothing put on.

In other typical commercial embodiments, the clothing articles are treated with only two or one of these odor-reducing agents. For example, when the clothing article is made of a material with particle barrier properties, then only one or two odor-reducing agents are needed, and they can be applied in dry or liquid form as may be desired. In other embodiments, the same dry powder form odor-reducing agent may be used on both the inside and the outside surfaces of the clothing article, instead of using one agent on the inside and another agent on the outside. And in still other alternative methods, one or more of the odor-reducing agents are impregnated into the material during the manufacture of the material itself, formed into a layer that is applied to the material during the manufacture of the material itself, or applied to the material in another method. In some of these embodiments, the clothing articles are treated with additional agents such as, for example, an odorless insect repellant such as pyrethrum and/or cover scents such as pine.

Figure 10:
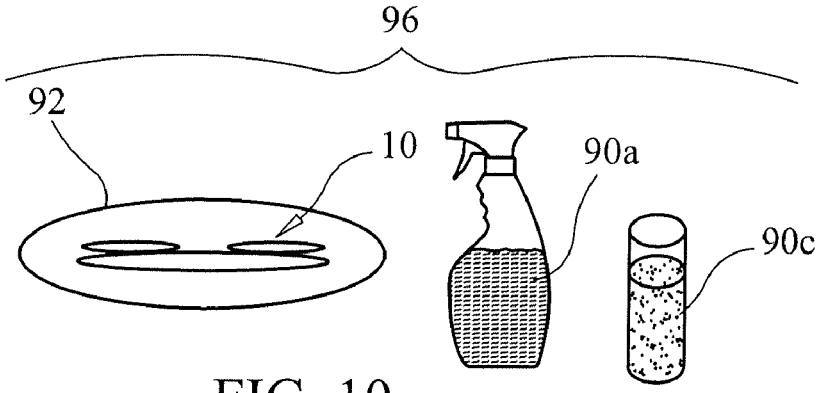
FIG. 10 is a side view of a home-assembly kit including the one or more of the untreated clothing articles and one or more of the odor-reducing agents.

In another aspect, the present invention includes a kit 96 for assembly at home by the end-user (see FIG. 10). The kit 96 includes at least one of the clothing articles 10 packaged in a resealable container 92 such as a resealable plastic bag with a closure (e.g., a ZIPLOC brand bag), and a supply of at least one of the odor-reducing agents 90. In a typical commercial embodiment, for example, the kit 96 includes liquid chlorophyll 90*a* and activated carbon powder 90*c*, and these odor-reducing agents are packaged in the bag 92 along with a full suit of the clothing articles 10. The odor-reducing agents 90 can be applied by the end-user at home using the same method 100 as described above. In addition, after using the clothing article 10 once, the user can reapply the odor-reducing agents 90 using the method 100, reseal the retreated clothing article in the bag 92, then later reuse the retreated clothing article 10.

In another aspect, the present invention includes a method of using the clothing articles for hunting. The method includes the steps of wearing a full or partial suit of the clothing articles to gain proximity to a game animal, then afterwards re-treating the clothing with one or more of the odor-reducing agents, reinserting the re-treated clothing articles into the bag or other container, and resealing the bag until the next use. The method can be repeated a few times to get on the order of about five to seven uses out of the clothing articles before disposal.

It is to be understood that this invention is not limited to the specific devices, methods, conditions, or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

While the invention has been described with reference to preferred and example embodiments, it will be understood by those skilled in the art that a variety of modifications, additions and deletions are within the scope of the invention, as defined by the following claims.

What is claimed is:

1. A method of manufacturing a low-cost, disposable, odor-reducing clothing article for an outdoorsman seeking proximity to game animals, comprising:

providing a clothing article made of a low-cost, lightweight, breathable, non-woven material, the non-woven material having particle barrier properties to at least partially prevent the escape of human odors therethrough, the clothing article including at least one cinching element that cinches closed to form a good seal to prevent the escape of human odors from the outdoorsman; and treating the clothing article with one or more low-cost odor-reducing agents selected for eliminating or reducing human odors, wherein wearing the resulting odor-reducing clothing article prevents the human odors of the outdoorsman from being detected by the game animals.

2. The method of claim 1, wherein the one or more odor-reducing agents comprise one or more dry powder form agents, and the step of treating the clothing article comprises sprinkling the dry powder odor-reducing agents on the clothing article.

3. The method of claim 2, wherein the clothing article has an inside surface and an outside surface, and the one or more dry powder agents comprise baking soda and activated carbon, and wherein the step of treating the clothing article comprises sprinkling the baking soda on the inside surface of the clothing article and sprinkling the activated carbon sprinkled on the outside surface of the clothing article.

4. The method of claim 2, wherein the one or more odor-reducing agents comprise one or more liquid form agents, and the step of treating the clothing article comprises spaying the liquid odor-reducing agents on the clothing article.

5. The method of claim 1, wherein the one or more odor-reducing agents comprise one or more liquid form agents, and the step of treating the clothing article comprises spaying the liquid odor-reducing agents on the clothing article.

6. The method of claim 5, wherein the clothing article has an inside surface and an outside surface, and the one or more liquid agents comprise chlorophyll, and wherein the step of treating the clothing article comprises spraying the chlorophyll on the inside surface, the outside surface, or both the inside and outside surfaces of the clothing article.

7. The method of claim 2, further comprising packaging the treated odor-reducing clothing article in a sealable container to retain the odor-reducing agent therein.

8. The method of claim 7, further comprising, after a use by the outdoorsman, retreating the clothing article with a supply of the one or more odor-reducing agents, reinserting the clothing article into the resealable container, and storing them for future use.

* * * * *